US006231207B1

(12) United States Patent
Kennedy et al.

(10) Patent No.: US 6,231,207 B1
(45) Date of Patent: May 15, 2001

(54) LIGHT EMITTING DIODE FLASHLIGHT LAMP

(76) Inventors: Douglas B. Kennedy, 471 S. Main St.; Greg J. Kennedy, 4471 S. Main St., both of Moab, UT (US) 84532

( * ) Notice: Subject to any disclaimer, the term of this patent is extended or adjusted under 35 U.S.C. 154(b) by 0 days.

(21) Appl. No.: 09/299,961

(22) Filed: Apr. 26, 1999

(51) Int. Cl.[7] ..... F21L 4/00

(52) U.S. Cl. ..... 362/158; 362/184; 362/188; 362/190; 362/194; 362/202; 362/238

(58) Field of Search ..... 362/158, 184, 362/194, 238, 239, 250, 202, 800, 188, 186, 190, 240

(56) References Cited

U.S. PATENT DOCUMENTS

| | | | | |
|---|---|---|---|---|
| 4,530,039 | * | 7/1985 | Shin-Shi | 362/158 |
| 4,967,321 | | 10/1990 | Cimock . | |
| 5,036,442 | | 7/1991 | Brown . | |
| 5,081,568 | | 1/1992 | Dong et al. . | |
| 5,392,203 | | 2/1995 | Harris, Jr. . | |
| 5,622,423 | | 4/1997 | Lee . | |
| 5,685,632 | * | 11/1997 | Schaller et al. | 362/205 |
| 5,697,695 | | 12/1997 | Lin et al. . | |

FOREIGN PATENT DOCUMENTS

| | | | | |
|---|---|---|---|---|
| 1494088 | * | 7/1967 | (FR) | 362/184 |

* cited by examiner

*Primary Examiner*—Sandra O'Shea
*Assistant Examiner*—Bertrand Zeade
(74) *Attorney, Agent, or Firm*—Trask Britt

(57) ABSTRACT

A flashlight including a hollow translucent member with one or more end caps is disclosed. Each end cap may include an LED, LED carrier, LED carrier socket, battery, switch, electrical coupling between the battery and switch. Each end cap may be reversible or have a plurality of LED carrier sockets facilitating configuration as a flashlight or lamp. The flashlight lamp operates in a flashlight mode when configured with one or more LEDs directing light away from the flashlight lamp. The flashlight lamp operates as a lamp when configured to emit light from within the hollow translucent member. The flashlight lamp may be configured to operate as both a flashlight and a lamp. The flashlight lamp may be watertight.

24 Claims, 7 Drawing Sheets

LIGHT EMITTING DIODE FLASHLIGHT LAMP

BACKGROUND OF THE INVENTION

1. Field of the Invention

This invention relates to the field of hand-held light sources. More particularly, this invention relates to a light emitting diode (LED) flashlight lamp.

2. Description of the Related Art

In the field of hand-held light sources which utilize LEDs, there are many devices with various applications including flashlights, signal sticks and lighted wands. Some devices provide omni-directional lighting for illuminating a region around the device in a fashion similar to a lamp. Other devices provide focused, concentrated or directional lighting for illuminating small regions or objects like a flashlight. Still other devices are used for signaling remote persons where neither omni-directional nor concentrated lighting is of importance.

For example, U.S. Pat. No. 5,697,695 to Lin et al. discloses a signal stick including a handle enclosing dry-cell batteries, a connector with a circuit board mechanically and electrically connected to one end of the handle, a transparent sleeve connected to the connector and an inner tube mounted within the sleeve. The transparent inner tube supports three rows of LEDs, each row being of a different color (i.e., yellow, green and red). The Lin et al. signal stick has end caps but they are not reversible. The Lin et al. device is used to hand-signal traffic in combination with various combinations of the LEDs for visibility. The Lin et al. device does not provide light for use by the user, but rather for visibility during signaling to others.

Similar examples include U.S. Pat. No. 5,622,423 to Lee and U.S. Pat. No. 5,081,568 to Dong et al. which disclose a hand-carried traffic control lights including a cylindrical handle holding batteries, a multi-stage switch cap, a longitudinal LED carrier extending from the handle and coupled to the batteries through the switch cap. The Lee apparatus includes a colored reflecting tube surrounding the LED carrier and an external tube surrounding the color reflecting tube. The Dong et al. device does not have an inner colored reflecting tube. Both devices have a conventional incandescent bulb mounted in an end cap for directional lighting.

None of the above patents appear to disclose an apparatus capable of being configured to operate as a lamp, a flashlight or both, wherein the apparatus is also watertight. It is desirable to have a lightweight device suitable for use in unlighted environments (e.g., in a tent at night, in a cave, in a dark room, etc.) that would provide light. Thus, there is a need in the art for a flashlight lamp.

BRIEF SUMMARY OF THE INVENTION

The present invention is a flashlight lamp. An embodiment of a flashlight lamp includes a hollow translucent cylindrical member with one closed end and one open end, wherein the open end has an end cap securely disposed therein. An end cap includes an LED and battery. An end cap may also include an LED carrier, one or more LED carrier sockets and a switch. The end cap may be reversible to allow configuration as a flashlight or lamp.

Another embodiment of a flashlight lamp includes a hollow translucent cylindrical member with two open ends, wherein each end includes an end cap. An end cap may be threadedly coupled to the inside or outside of the hollow translucent member. Alternatively, an end cap may be slidably coupled to the inside, outside or within the hollow translucent member.

These embodiments and attendant advantages of the invention will be readily understood by reading the following detailed description in conjunction with the accompanying figures of the drawings.

BRIEF DESCRIPTION OF THE DRAWINGS

In the drawings, which illustrate what is currently regarded as the best mode for carrying out the invention, and in which like reference numerals refer to like parts in different views or embodiments.

DETAILED DESCRIPTION OF THE INVENTION

Figure 1:
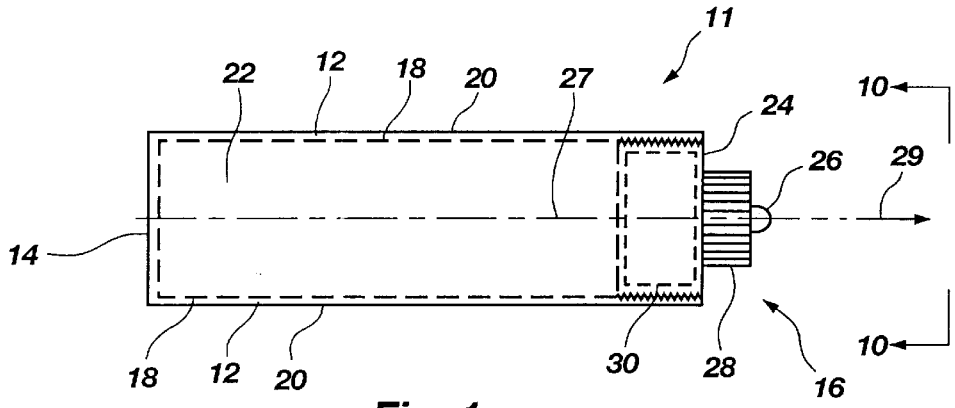
FIG. 1 is a side view an embodiment of a flashlight lamp in accordance with this invention.

The following detailed description discloses various embodiments of a flashlight lamp. FIG. 1 is a cross-sectional view of an embodiment of a flashlight lamp 11 in accordance with this invention. This embodiment of a flashlight lamp 11 includes a hollow translucent cylindrical member 12 with a closed end 14, an open end 16, an inner wall 18 and an outer surface 20. Hereinafter the terms "hollow translucent cylindrical member" and "cylindrical member" will be used synonymously. The cylindrical member 12 may be formed of a plastic or plastic-like material, such as but not limited to DACRON, TEFLON, polytetrafluoroethylene (PTFE) and NYLON. The cylindrical member 12 may be clear or colored. Furthermore, the cylindrical member 12 may include a means for dispersing light, emanating from within, in virtually every direction externally. Such light dispersing means may be a property of the material from which the cylindrical member is formed. The light dispersing means may be one or more light reflecting objects (not shown) within the inner cavity 22. Alternatively, the light dispersing means may be a coating of light dispersing material on either the inner wall 18, or the outer surface 20, or both. The closed end 14 may be formed of the same material as the rest of the cylindrical member 12, i.e., integrally formed with the cylindrical member 12 and analogous to the bottom of a cup.

The closed end 14 may be a plug formed in one of two open ends of the tubular cylindrical member 12. Alternatively, the closed end 14 may comprise a material that reflects internally incident light back into the inner cavity 22 within the cylindrical member 12.

The open end 16 is shown with an end cap 24 securely disposed within the open end 16 of the cylindrical member 12. The end cap 24 includes an LED 26 which may be mounted in an LED carrier 28 and a battery 30. The end cap 24 may have a switch (not shown) for selectively energizing the LED 26. Such a switch may, for example and not by way of limitation, be a rocker switch, a multi-position slider switch, a rotational switch or a push-button switch. The end cap 24 is shown with the LED 26 directing light in a direction along the axis (see dotted line 27) of the flashlight lamp 11 and in a direction outward from (see arrow 29) the flashlight lamp 11. In this configuration, the flashlight lamp 11 operates like a flashlight with a focused beam directed by the user. The end cap 24 may be reversible. With the end cap 24 reversed, light from the LED 26 is directed into the inner cavity 22, whereupon light may pass through the translucent cylindrical member 12, thus operating like a lamp or omni-directional light source. Alternatively, the end cap may have LED carrier sockets (not shown) in which an LED carrier 28 may be placed on either side of said end cap 24 or both.

The LED 26 may be any LED that emits light in the visible range of the electromagnetic spectrum, i.e., wavelengths from approximately 390 nm to approximately 770 nm. Table 1 below, lists exemplary semiconductor materials for visible LEDs suitable for use in this invention.

TABLE 1

| Semiconductor Material for Visible LED | Color Band |
|---|---|
| gallium nitride (GaN) | Violet |
| gallium arsenide - phosphor (GaAs-Phosphor) | Blue |
| zinc sulphide (ZnS) | Blue |
| silicon carbide (SiC) | Blue |
| gallium phosphide doped with nitrogen (GaP:N) | Green |
| $Ga_{.14}P_{.86}$ | Yellow |
| $Ga_{.35}P_{.65}$ | Orange |
| GaP:ZnO | Red |
| $Ga_{.6}P_{.4}$ | Red |

The materials listed in Table 1 are exemplary only and not intended to be an exhaustive list of suitable materials for a visible LED.

The battery 30 may be formed of any conventional technology such as, for example, lithium ion, nickel-metal-hydride, nickel-cadmium, or alkline. Lithium ion is currently the preferred technology for the battery 30 because of its high energy density. The battery 30 may be rechargeable or disposable. The battery 30 may be 25 replaceable individually, or integrated with an end cap 24 and/or an LED carrier 28.

The battery 30 may be comprised of more than one battery. For example, if a particular LED requires 6 volts to operate properly, two batteries in series, each battery nominally delivering 3 volts with sufficient current would suffice as a battery 30 in accordance with this invention.

Figure 2:
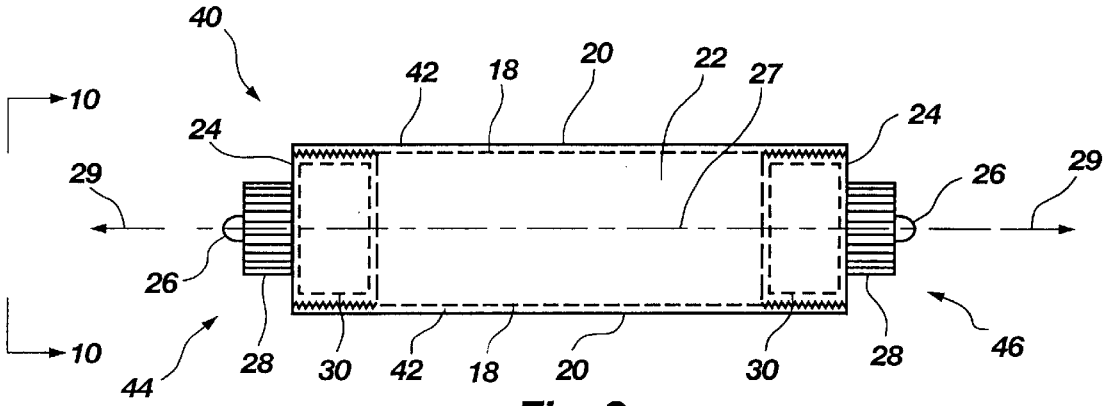
FIG. 2 is a side view of another embodiment of a flashlight lamp in accordance with this invention.

Referring to FIG. 2, a cross-sectional view of another embodiment of a flashlight lamp 40 is illustrated. This embodiment includes a hollow translucent cylindrical member 22 with a first end 44, a second end 46, an inner wall 18 and an outer surface 20. The cylindrical member 42 is formed of a plastic or plastic-like material, similar to those as detailed for the flashlight lamp 11 above. The cylindrical member 42 may be clear or colored. Furthermore, the cylindrical member 42 may include a means for dispersing light emanating from within in virtually every direction externally. Such light dispersing means may be a property of the material from which the cylindrical member is formed. The light dispersing means may be one or more light reflecting objects (not shown) within the inner cavity 22. Alternatively, the light dispersing means may be a coating of light dispersing material on either the inner wall 18, or the outer surface 20, or both.

The embodiment of a flashlight lamp 40 illustrated in FIG. 2 also includes two end caps 24 each disposed within, and secured to, the first end 44 and to the second end 46, respectively. The two end caps 24 are substantially identical and interchangeable, i.e., each end cap 24 is configured to couple either to the first end 44 or to the second end 46 of the cylindrical member 22. End caps 24 may have different colors, finishes or other aesthetic appearance from one another. Each end cap 24 includes an LED 26, which may be mounted in an LED carrier 28, and a battery 30. Each end cap 24 may have a switch (not shown) for selectively energizing each LED 26. Each end cap 24 may be reversible. In the embodiment of a flashlight lamp 40 illustrated in FIG. 2, each LED 26 directs light along the axis 27 of the flashlight lamp 40 in directions away from 29 the flashlight lamp 40. In this configuration, the flashlight lamp 40 may operate a dual-direction flashlight if both LED's 26 are energized. Alternatively, a single LED 26 may be energized and the flashlight lamp 40 operates like a flashlight.

Figure 3:
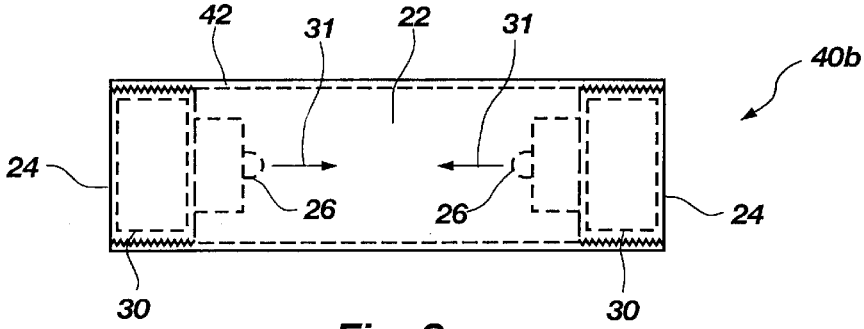
FIG. 3 is a side view of yet another embodiment of a flashlight lamp in accordance with this invention.

FIG. 3 illustrates an alternate configuration of the flashlight lamp **40*b* illustrated in FIG. 2. In the flashlight lamp 40*b*, each end cap 24 is reversed, whereby light from one or both LEDs 26 may be switchably energized, directing light into (see arrows 31) the inner cavity 22** thus, operating as a lamp. In this alternate configuration, two levels of light intensity are possible: a low intensity, where one LED is energized and a high intensity, where both LEDs are energized.

Figure 4:
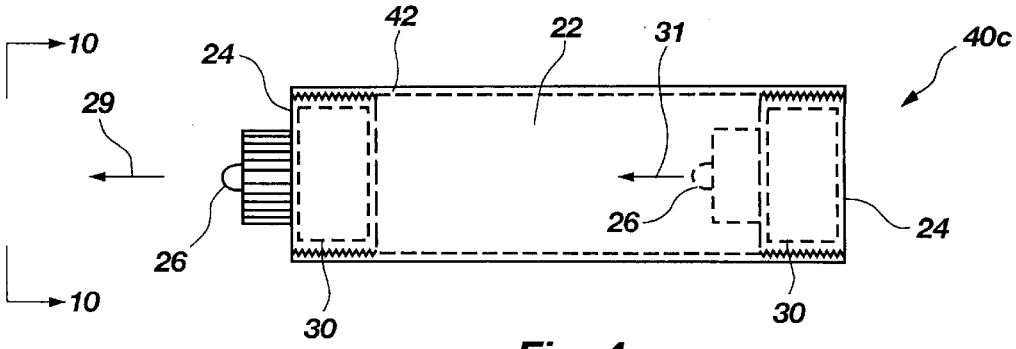
FIG. 4 is a side view of yet still another embodiment of a flashlight lamp in accordance with this invention.

FIG. 4 illustrates a variation on the configurations illustrated in FIGS. 2 and 3. The flashlight lamp **40*c* of FIG. 4 includes one end cap 24 with LED 26 directing light outward 29, and the other end cap 24 with LED 26 directing light inward 31. With both LEDs 26 energized in this variation, the flashlight lamp 40*c* operates as both a lamp and a flashlight. Where only one LED 26 is energized, the flashlight lamp 40*c* operates as a flashlight or a lamp depending on the direction of the single LED 26**.

Figure 5:
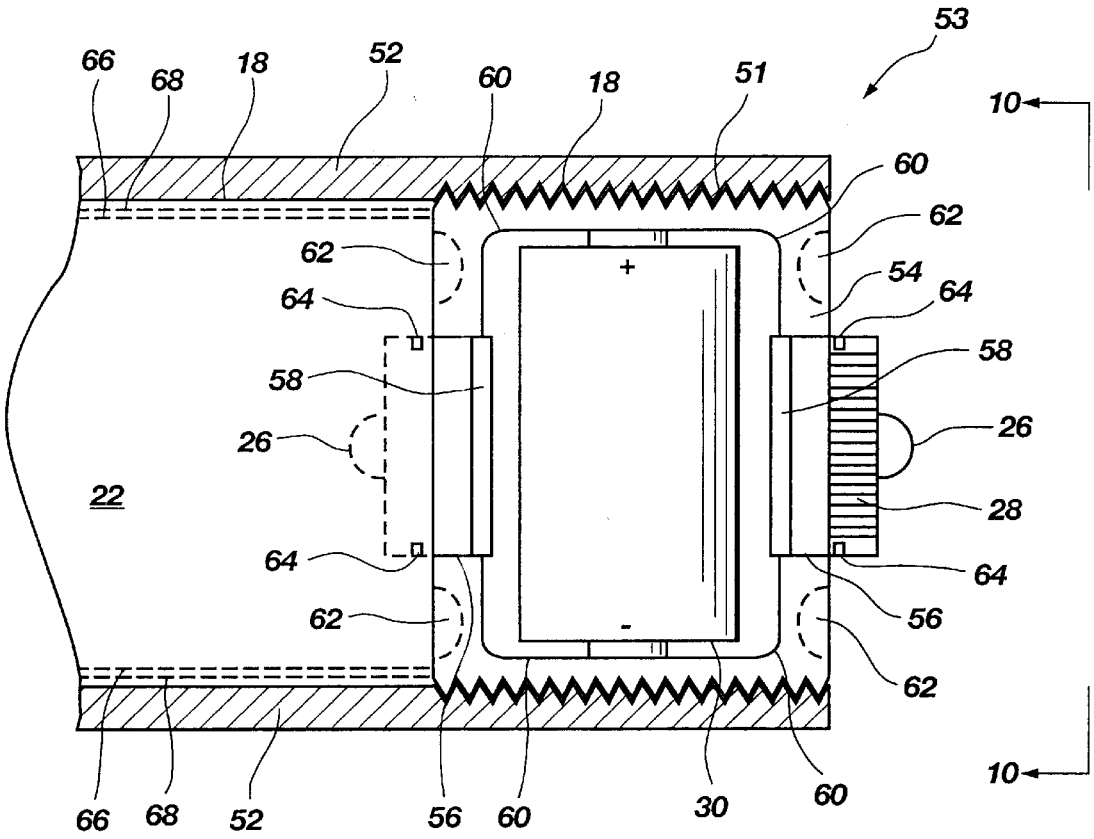
FIG. 5 illustrates a cross-sectional view of one end of a flashlight lamp wherein an end cap is shown threadedly engaged with the inside of a cylindrical member.

FIG. 5 illustrates a cross-section of one end 53 of a flashlight lamp 11, 40, **40*b* and 40*c*, wherein an end cap 54 is threadedly engaged 51 with the inner wall 18 of a cylindrical member 52. The terms "threadedly engaged 51" and "threaded engagement 51" are used synonymously herein. End 53 may be an open end 16 of a cylindrical member 12 as shown in FIG. 1. Alternatively, end 53 may be one end of a cylindrical member 42 as illustrated in FIGS. 2–4. End cap 54 includes a battery 30, at least one LED carrier socket 56 (two are shown), one LED carrier 28, at least one switch 58 (two are shown) and electrical coupling 60 between the battery 30 and switch 58. A filter 66 or light dispersing means 68 may be placed inside the cavity 22 of the cylindrical member 52 between the LED 26 and the inner wall 18 when the flashlight lamp 11, 40*b* and 40*c* is configured as a lamp. The threaded engagement 51** may be a water tight seal, such as a labyrinth seal.

The end cap 54 may include means for threadedly engaging 62 the end cap 54 with the cylindrical member 52. Such means for threadedly engaging 62 may be slots or holes in the end cap 54 for placing digits (or any special tool, such as a spanner, wrench, screwdriver, etc.) against and rotating. The means for threadedly engaging 62 allows the user to remove or secure the end cap 54 as necessary. The end cap 54 may be reversible such that if only one LED 26 and LED carrier 28 are provided, the end cap 54 may be reversed to change from flashlight configuration to lamp configuration and vice versa. LED carrier 28 may have a notch 64 (a plurality of which are shown) for use with a lever (not shown) to allow disengaging from the LED carrier socket 56.

Figure 6:
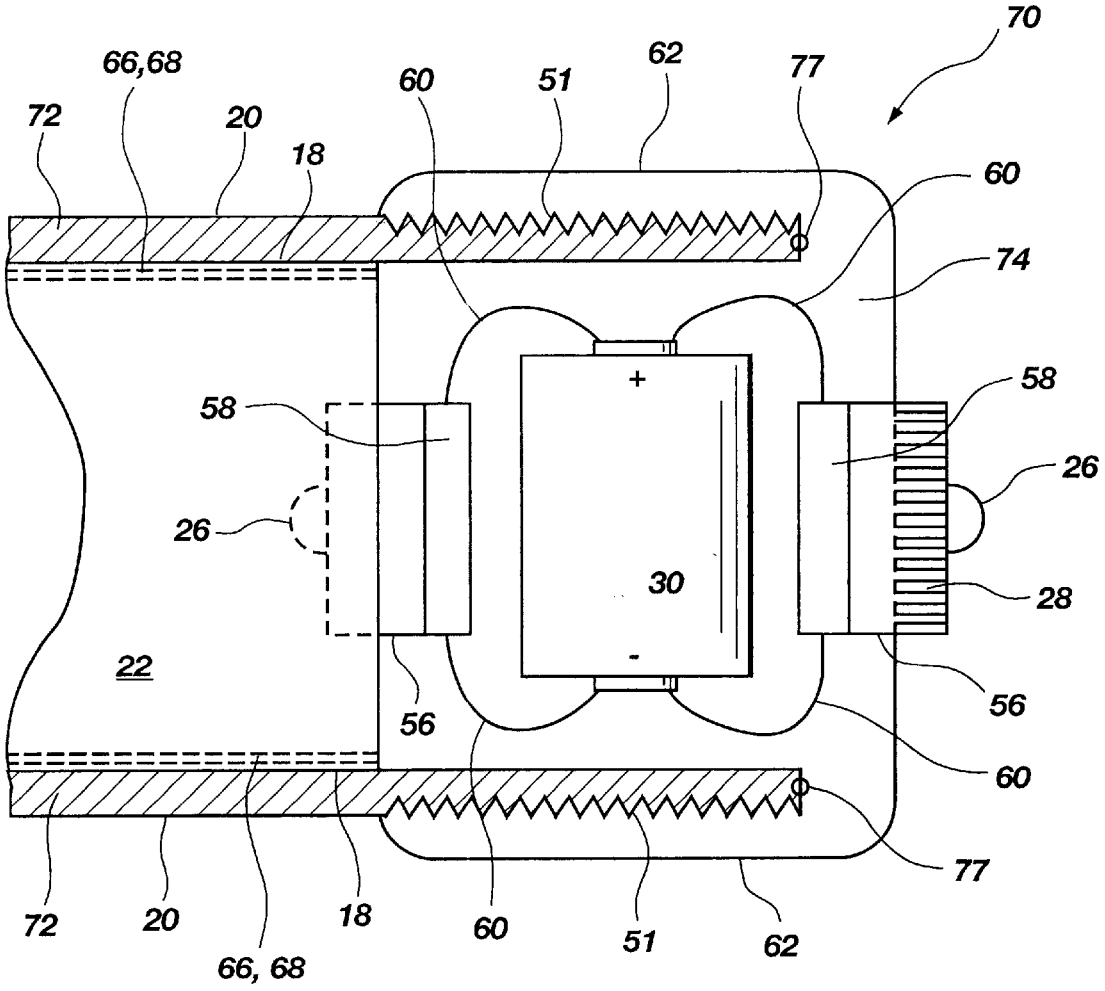
FIG. 6 illustrates a cross-sectional view of one end of a flashlight lamp wherein an end cap is shown threadedly engaged with the outside of a cylindrical member.

FIG. 6 illustrates an alternative cross-section of one end 70 of a flashlight lamp 11, 40, 40*b* and 40*c*, wherein an end cap 74 is threadedly engaged 51 with the outer surface 20 of a cylindrical member 72. End 70 may be an open end 16 in a cylindrical member 12 as shown in FIG. 1. Alternatively, end 70 may be one end of a cylindrical member 42 as illustrated in FIGS. 2–4. End cap 74 includes a battery 30, at least one LED carrier socket 56 (two are shown), one LED carrier 28, at least one switch 58 (two are shown) and electrical coupling 60 between the battery 30 and switch 58. A filter 66 or light dispersing means 68 may be placed inside the cavity 22 of the cylindrical member 52 between the LED 26 and the inner wall 18 when the flashlight lamp 11, 40*b* and 40*c* is configured as a lamp. The threaded engagement 51 may be a watertight seal, such as a labyrinth seal. The threaded engagement 51 may also include an O-ring 77 to effect a watertight seal.

The end cap 74 may include means for threadedly engaging 62 the end cap 74 with the cylindrical member 72. Such means for threadedly engaging 62 may be knurling or slots along the outer surface 79 of the end cap 74 for increasing friction when rotationally engaging and disengaging the end cap 74 from the cylindrical member 72. The means for threadedly engaging 62 allows the user to remove or secure the end cap 74 as necessary.

Figure 7:
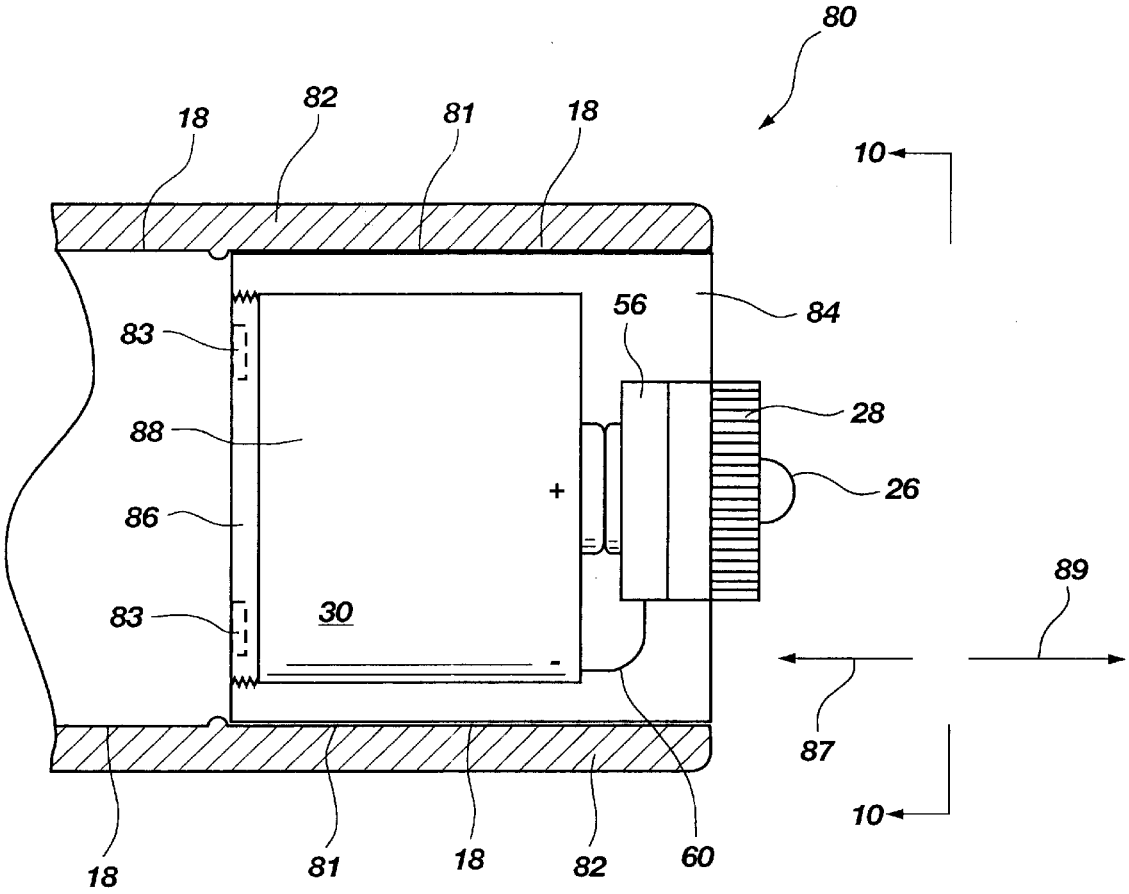
FIG. 7 illustrates a cross-sectional view of one end of a flashlight lamp wherein an end cap is shown slidably engaged with the inside of a cylindrical member.

FIG. 7 illustrates yet another alternative cross-section of one end 80 of a flashlight lamp 11, 40, 40*b* and 40*c*, wherein an end cap 84 is slidably engaged 81 with the inner wall 18 of a cylindrical member 82. End 80 may be an open end 16 of a cylindrical member 12 as shown in FIG. 1. Alternatively, end 80 may be one end of a cylindrical member 42 as illustrated in FIGS. 2–4. The slidable engagement 81 may form a watertight seal between the inner wall 18 of the cylindrical member 82 and the end cap 84. Cylindrical member 82 may include an integral rib 83 along the inner wall 18 to act as a stop when the end cap 84 is inserted (see arrow 87) into cylindrical member 82. End cap 84 may have a means for removing (see arrow 89 for direction of removal) the end cap 84 from the cylindrical member 82 once inserted. Such means for removing (not illustrated for clarity) may be a ring, pull tab or other similar means as is well known to one of skill in the art. The end cap 84 may be reversible such that if only one LED 26 and LED carrier 28 are provided, the end cap 84 may be reversed to change from flashlight configuration to lamp configuration and vice versa. The end cap 84 may have a lid 86 which provides access to a battery compartment 88. The lid 86 may also have a watertight seal between the lid 86 and the end cap 84. Furthermore, the lid 86 may have notches 83 or other similar means for engaging and disengaging the lid 86 from the end cap 84.

Figure 8:
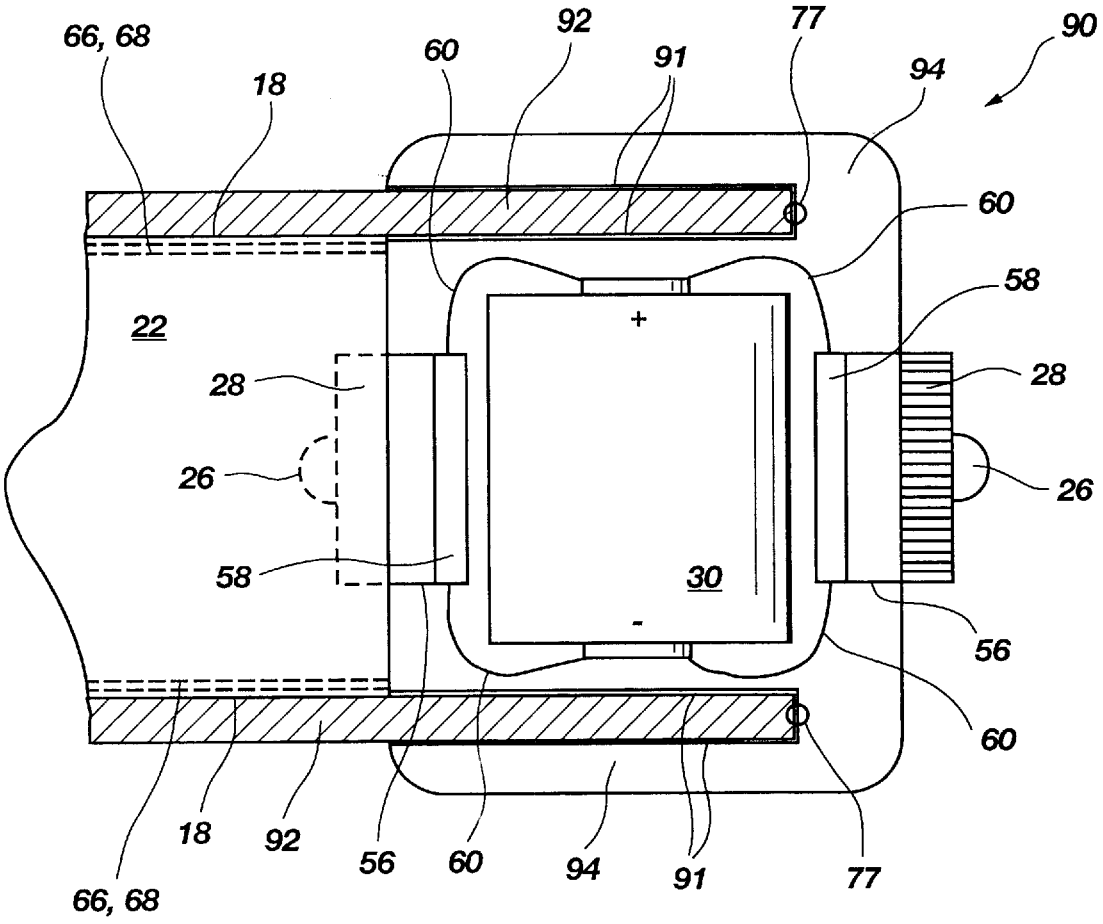
FIG. 8 illustrates a cross-sectional view of one end of a flashlight lamp wherein an end cap is shown slidably engaged with the outside of a cylindrical member.

FIG. 8 illustrates still yet another alternative cross-section of one end 90 of a flashlight lamp 11, 40, 40*b* and 40*c*, wherein an end cap 94 is slidably engaged 91 with the outer surface 20 of a cylindrical member 92. End 90 may be an open end 16 of a cylindrical member 12 as shown in FIG. 1. Alternatively, end 90 may be one end of a cylindrical member 42 as illustrated in FIGS. 2–4. End cap 94 includes a battery 30, at least one LED carrier socket 56 (two are shown), one LED carrier 28, at least one switch 58 (two are shown) and electrical coupling 60 between the battery 30 and switch 58. A filter 66 or light dispersing means 68 may be placed inside the cavity 22 of the cylindrical member 92 between the LED 26 and the inner wall 18 when the flashlight lamp 11, 40*b* and 40*c* is configured as a lamp. The slidable engagement 91 may form a watertight seal between the inner wall 18 of the cylindrical member 92 and the end cap 94. The threaded engagement 91 may also include an O-ring 77 to effect a watertight seal.

Figure 9:
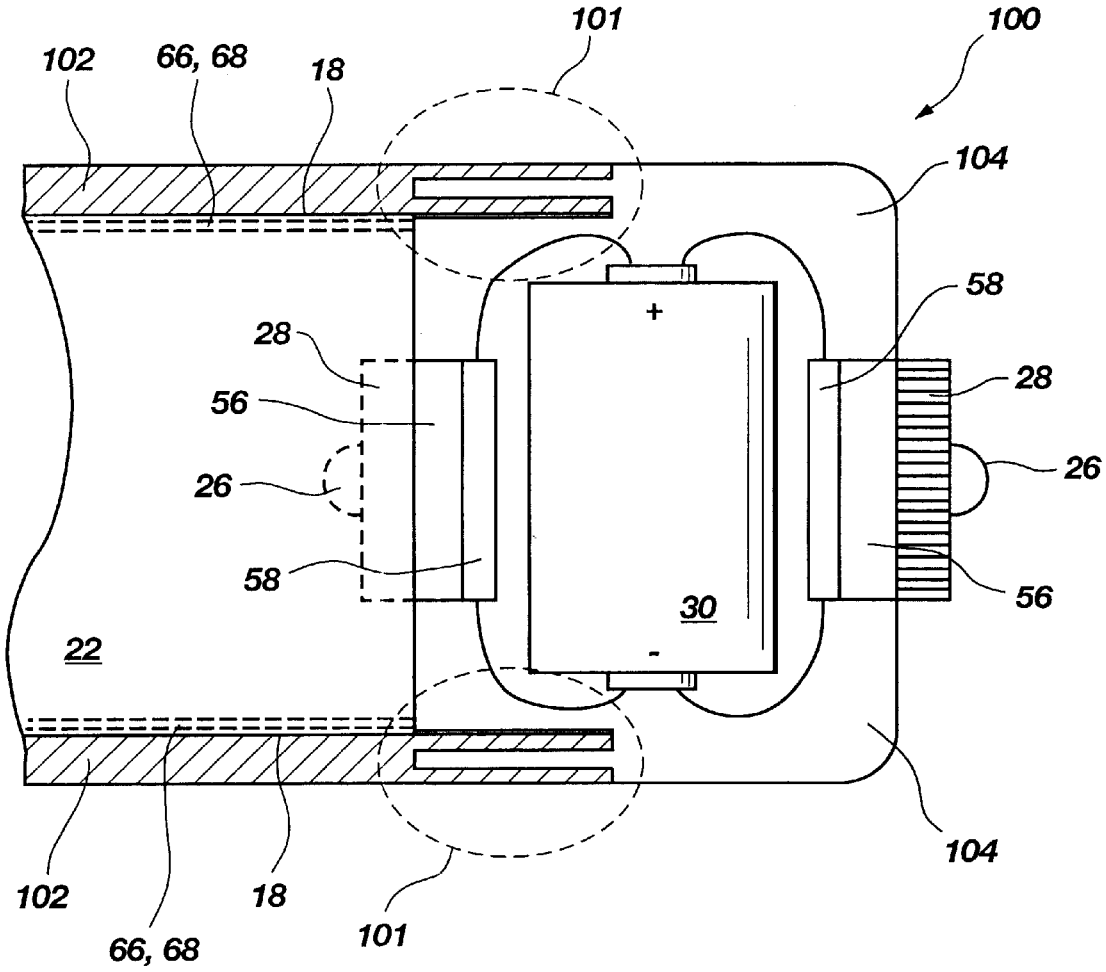
FIG. 9 illustrates a cross-sectional view of one end of a flashlight lamp wherein an end cap is shown slidably engaged within an end of a cylindrical member.

FIG. 9 illustrates another variation of a cross-section of an end 100 of a flashlight lamp 10, 40, 40*b* and 40*c*, wherein an end cap 104 is slidably engaged 101 within a cylindrical member 102. The slidable engagement 101 is shown as a circular tongue and groove. End 100 may be an open end 16 of a cylindrical member 12 as shown in FIG. 1. Alternatively, end 100 may be one end of a cylindrical member 42 as illustrated in FIGS. 2–4. End cap 104 includes a battery 30, at least one LED carrier socket 56 (two are shown), one LED carrier 28, at least one switch 58 (two are shown) and electrical coupling 60 between the battery 30 and switch 58. A filter 66 or light dispersing means 68 may be placed inside the cavity 22 of the cylindrical member 92 between the LED 26 and the inner wall 18 when the flashlight lamp 11, 40*b* and 40*c* is configured as a lamp. The slidable engagement 101 may form a watertight seal between the inner wall 18 of the cylindrical member 102 and the end cap 104. The threaded engagement 101 may also include an O-ring 77 (not shown) to effect a watertight seal.

Figure 10:
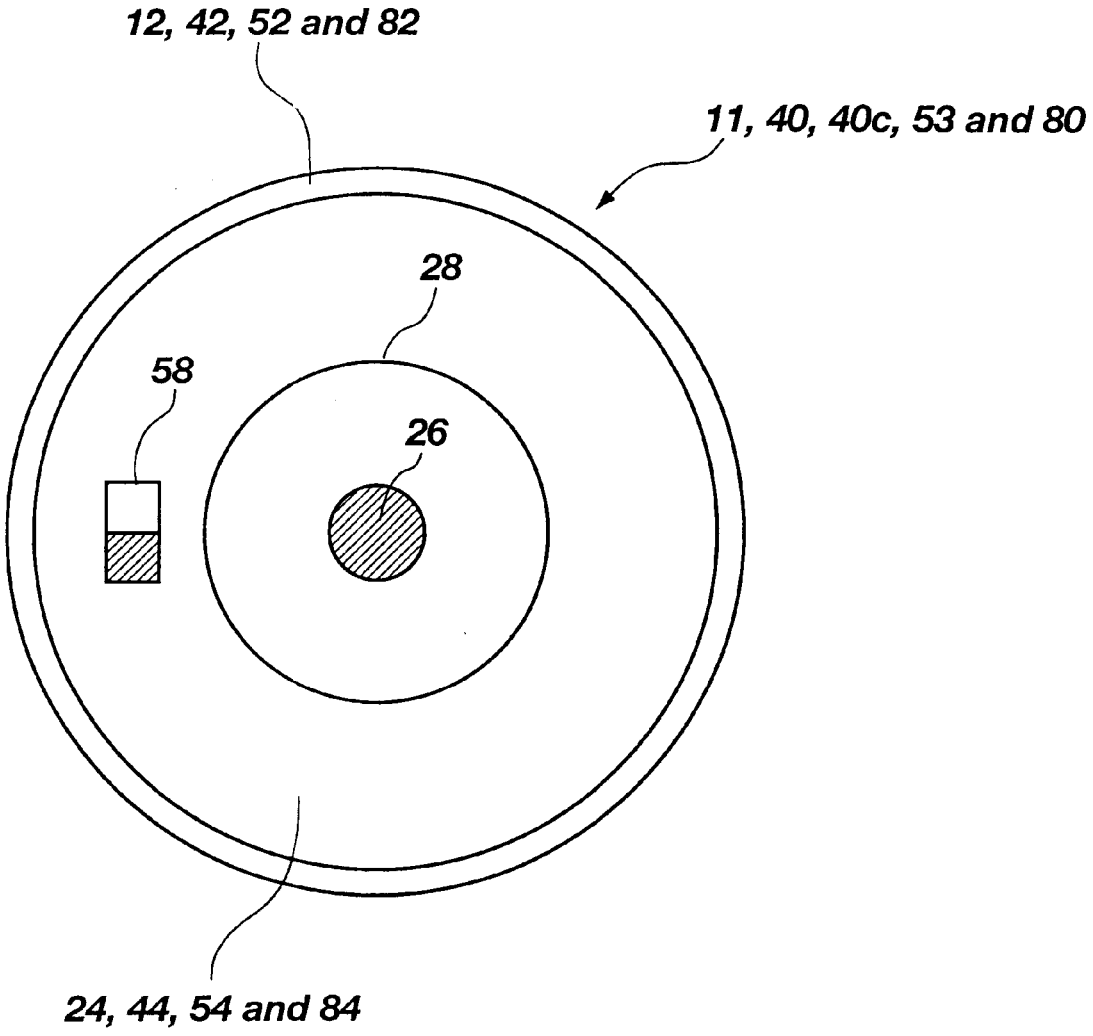
FIG. 10 illustrates a front view of a flashlight lamp in accordance with this invention.

FIG. 10 illustrates a front view of a flashlight lamp 11, 40, 40*c*, 53 and 80 in accordance with this invention. The flashlight lamp 11, 40, 40*c*, 53 and 80 of FIG. 10 shows the end cap 24, 44, 54 and 84 secured within an end of the flashlight lamp 11, 40, 40*c*, 53 and 80. End cap 24, 44, 54 and 84 may include an external switch 58 as shown.

Although this invention has been described with reference to particular embodiments, the invention is not limited to these described embodiments. Rather, it should be understood that the embodiments described herein are merely exemplary and that a person skilled in the art may make many variations and modifications without departing from the spirit and scope of the invention. For example, a person skilled in the art may combine any of the features illustrated or described in a given embodiment above in another embodiment which may not have such feature illustrated or described.

All such variations and modifications are intended to be included within the scope of the invention as defined in the appended claims.

What is claimed is:

1. A flashlight lamp, comprising:

a hollow translucent cylindrical member including a closed end, at least one open end, an inner wall and an outer surface;

an end cap capable of watertight seal against said at least one open end including a light emitting diode (LED) having two configurations, said first configuration capable of providing directional lighting along the axis of said hollow translucent cylindrical member and in a direction away from said hollow translucent cylindrical member and said second configuration capable of providing omni-directional lighting from light emanating within said hollow translucent cylindrical member.

2. The flashlight lamp of claim 1, wherein said closed end comprises a plug.

3. The flashlight lamp of claim 1, wherein said closed end comprises an integrally sealed end formed in said hollow translucent member.

4. The flashlight lamp of claim 1, further comprising a light dispersing means within said hollow translucent cylindrical member.

5. The flashlight lamp of claim 4, wherein said light dispersing means is a colored translucent cylindrical filter within said hollow translucent cylindrical member for coloring and dispersing light emanating from within said hollow translucent cylindrical member.

6. The flashlight lamp of claim 1, wherein said end cap further comprises: at least one battery for providing electrical energy to energize said LED; and a switch for selectively coupling said battery to said LED.

7. The flashlight lamp of claim 6, wherein said switch is selected from the group comprising rocker, slider, rotational and push-button.

8. The flashlight lamp of claim 1, wherein said end cap screws into threads formed within said inner wall toward said open end of said hollow translucent cylindrical member providing a watertight seal between said end cap and said hollow translucent cylindrical member.

9. The flashlight lamp of claim 1, wherein said end cap screws onto threads formed on said outer surface toward said open end of said hollow translucent cylindrical member providing a watertight seal between said end cap and said hollow translucent cylindrical member.

10. The flashlight lamp of claim 1, wherein said end cap press-fits against said inner wall toward said open end of said hollow translucent cylindrical member providing a watertight seal between said end cap and said hollow translucent cylindrical member.

11. The flashlight lamp of claim 1, wherein said end cap press-fits against said outer surface toward said open end of said hollow translucent cylindrical member providing a watertight seal between said end cap and said hollow translucent cylindrical member.

12. The flashlight lamp of claim 1, wherein said end cap press-fits within a slot formed within said hollow translucent cylindrical member at said open end providing a watertight seal between said end cap and said hollow translucent cylindrical member.

13. A flashlight lamp, comprising:

a hollow translucent cylindrical member having a first end and a second end;

a first end cap and a second end cap, said first end cap coupled to said first end and said second end cap coupled to said second end, both end caps being substantially identical and interchangeable and including at least one light source mounted therein.

14. The flashlight lamp of claim 13, wherein said hollow translucent cylindrical member disperses light, emanating from within, omni-directionally.

15. The flashlight lamp of claim 13, wherein said hollow translucent cylindrical member is formed of a plastic-like material.

16. The flashlight lamp of claim 15, wherein said plastic material is selected from the group consisting of DACRON, TEFLON, polytetrafluoroethylene (PTFE) and NYLON.

17. The flashlight lamp of claim 13, wherein each of said two end caps is reversible.

18. The flashlight lamp of claim 13, wherein each of said two end caps further comprise:

at least one light emitting diode (LED);

at least one battery; and a switch electrically coupling the at least one LED to the at least one battery for selectively energizing said at least one LED.

19. The flashlight lamp of claim 18, wherein said at least one LED emits light along the axis of said hollow translucent cylindrical member and in a direction away from said hollow translucent cylindrical member.

20. The flashlight lamp of claim 18, wherein said at least one LED emits light along the axis of said hollow translucent cylindrical member and into said hollow translucent cylindrical member.

21. The flashlight lamp of claim 18, wherein said at least one battery is selected from the group consisting of alkaline, nickel-metal-hydride and lithium ion.

22. The flashlight lamp of claim 13, wherein each of said two end caps further includes two sockets for mounting an LED carrier, each socket disposed at opposite sides of each of said two end caps.

23. The flashlight lamp of claim 13, further comprising means for dispersing longitudinally directed light from an LED omni-directionally.

24. The flashlight lamp of claim 23, wherein said means for dispersing longitudinally directed light from an LED omni-directionally is a colored translucent cylindrical filter within said hollow translucent cylindrical member for coloring and dispersing light emanating from within said hollow translucent cylindrical member.

* * * * *

UNITED STATES PATENT AND TRADEMARK OFFICE

CERTIFICATE OF CORRECTION

PATENT NO. : 6,231,207 B1
DATED : May 15, 2001
INVENTOR(S) : Douglas B. Kennedy and Gregory J. Kennedy It is certified that error appears in the above-identified patent and that said Letters Patent is hereby corrected as shown below:

Title page,
Item [76], Inventors, change "Greg" to -- Gregory --

Column 1,
Line 36, change "lights" to -- light --

Column 2,
Line 14, after "view" and before "an" insert -- of --

Column 3,
Line 54, delete "25"
Line 65, change "22" to -- 42 --

Column 4,
Line 26, change "away from 29" to -- 29 away from --

Column 5,
Line 24, change "52" to -- 72 --
Line 47, change "rib 83" to -- rib 85 --

Column 6,
Line 32, change "threaded" to -- slidable --
Lines 35 and 36, after "40c" and before "53" insert -- and ends --
Line 37, after "end" and before "of" insert -- 53 and 80 --
Line 38, delete the comma after "40c" and delete "53 and 80"

Signed and Sealed this

Seventeenth Day of June, 2003

JAMES E. ROGAN
*Director of the United States Patent and Trademark Office*